United States Patent [19]

Raasch

[11] Patent Number: 4,972,669

[45] Date of Patent: Nov. 27, 1990

[54] AUTOMATIC SPINNING MACHINE WITH SILVER CAN REPLACING APPARATUS

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 400,455

[22] Filed: Aug. 30, 1989

[30] Foreign Application Priority Data

Sep. 17, 1988 [DE] Fed. Rep. of Germany ..... 3831640

[51] Int. Cl.[5] ..... D01H 9/18

[52] U.S. Cl. ..... 57/281; 19/159 A; 57/90; 57/276

[58] Field of Search ..... 57/281, 90, 276, 277; 19/159 R, 159 A

[56] References Cited

U.S. PATENT DOCUMENTS 4,150,534 4/1979 Raasch ..... 57/281

FOREIGN PATENT DOCUMENTS 0220200 8/1988 European Pat. Off. .
1292049 11/1969 Fed. Rep. of Germany .
2352649 5/1974 Fed. Rep. of Germany .
2518224 11/1976 Fed. Rep. of Germany .
2536479 2/1977 Fed. Rep. of Germany .
2554915 6/1977 Fed. Rep. of Germany .
3440598 5/1986 Fed. Rep. of Germany .
3505496 8/1986 Fed. Rep. of Germany .
3524922 1/1987 Fed. Rep. of Germany .
3532172 3/1987 Fed. Rep. of Germany .
3621370 3/1987 Fed. Rep. of Germany .
3614654 11/1987 Fed. Rep. of Germany .
3627062 1/1988 Fed. Rep. of Germany .
623614 6/1981 Switzerland .
614430 12/1948 United Kingdom .

OTHER PUBLICATIONS

"Garnfehleruberwachung", *Textilpraxis International*, Sep. 1977, pp. 1037, 1038, 1043, 1044.

*Primary Examiner*—John Petrakes
*Attorney, Agent, or Firm*—Shefte, Pinckney & Sawyer

[57] ABSTRACT

An automatic sliver can replacement apparatus is combined with an automatic spinning machine for replacing empty sliver cans with full sliver cans. Sliver supporting carriages are guided to travel along the spinning machine with full sliver cans being supported at alternating can locations on the carriages and intermediate can supporting locations being unoccupied for supporting empty sliver cans. Another carriage movable along the spinning machine supports a can manipulating mechanism equipped with sensors to recognize and distinguish empty and full cans on the transport carriages, the manipulating mechanism being operable in association with the sensors to transfer empty cans from the spinning positions to the empty can locations on the carriages and to transfer full sliver cans from the carriages to the spinning positions of the spinning machine.

6 Claims, 2 Drawing Sheets

AUTOMATIC SPINNING MACHINE WITH SILVER CAN REPLACING APPARATUS

BACKGROUND OF THE INVENTION

The present invention relates to the combination of an automatic spinning machine of the type having a plurality of spinning positions each adapted for receiving a supply of sliver delivered from a respective sliver cam with an apparatus for replacing empty sliver cans at the spinning positions of the spinning machine with full replacement sliver cans.

It is known to transport cans filled with sliver on a traveling conveyor belt from which the cans may be manually transferred to a sliver processing machine, such as an open end spinning machine or another automatic spinning machine.

It is accordingly an object of the present invention to provide an apparatus by which empty sliver cans at the spinning positions of a spinning machine may be automatically replaced with full sliver cans in order to improve the efficiency of the spinning operation.

SUMMARY OF THE INVENTION

Briefly summarized, the present invention provides a sliver can replacement apparatus arranged in combination with an automatic spinning machine and having an arrangement for transporting sliver cans alongside the spinning positions of the spinning machine with certain locations on the transporting arrangement being provided for supporting full sliver cans and other locations on the transporting arrangement being provided for supporting empty sliver cans at the same time. An automatic can replacement arrangement is also provided for traveling movement alongside the spinning positions of the spinning machine in association with the can transporting arrangement, the can replacement arrangement including a sensing arrangement for recognizing and distinguishing full sliver cans and empty sliver cans on the transporting arrangement and an associated can transferring arrangement for transferring empty sliver cans from the spinning positions of the spinning machine to the empty can locations of the transporting arrangement and for transferring full sliver cans from the full can locations of the transporting arrangement to the spinning positions of the spinning machine.

The traveling can replacement arrangement is operative, either during its traveling movement or when it is parked at a spinning position of the spinning machine, to recognize whether the sliver can in feeding operation at the spinning position has become completely depleted of its sliver supply or is imminently nearing complete sliver depletion. If the sliver can is already emptied so that the spinning position has ceased operation for such reason, the can replacement arrangement is operated immediately to perform a can replacement operation. On the other hand, if the sliver can is not yet completely emptied so that the spinning position is still operating, the can replacement arrangement may be adapted to cause the spinning operation to be interrupted and then to immediately initiate a can replacement operation even though a small amount of unused sliver will remain in the nearly emptied can. As will be understood, it is generally more advantageous in such instances to sacrifice a small quantity of sliver in order to minimize the period of time during which the spinning operation is interrupted at the spinning position than to postpone the can replacement operation until the sliver can has fully emptied and the spinning position has ceased operation for some period of time.

In the preferred embodiment of the present invention, the can transporting arrangement includes a conveyor arranged for traveling movement along the spinning positions of the spinning machine, the conveyor having the full and empty can locations arranged thereon in a predetermined sequence at substantially equal spacings along the length of the conveyor. Importantly, the sensing arrangement is capable of recognizing unoccupied empty can locations on the conveyor whereat empty cans removed from the spinning positions of the spinning machine may be placed and also is capable of recognizing and distinguishing occupied full can locations on the conveyor from which full cans of sliver may be transferred to the spinning positions of the spinning machine from which empty cans have been removed.

The transporting arrangement may include a guide track extending alongside the spinning positions of the spinning machine and a plurality of can supporting carriages coupled to one another and movably supported on the track for guided movement therealong. A traction arrangement is coupled to at least one of the carriages for advancing the carriages along the track. Depending upon the particular operating environment, each carriage may be relatively small having only a single location for supporting a sliver can or, alternatively, may be relatively large having two or more locations capable of supporting a sliver can. The traction arrangement may be of any suitable type, such as an endless cable, chain or similar means of applying a traction force to the carriages. Alternatively, a locomotive-type drive vehicle may be supported on the track in coupled engagement with the carriages for applying a traction force for traveling movement of the carriages along the track.

According to a further aspect of the present invention, each full can location of the transporting arrangement includes a detectable indicator to reflect that the location is a full can location and each empty can location of the transporting arrangement similarly includes a detectable indicator to reflect that the location is an empty can location. Various types of such indicators may be utilized. For example, the can supporting carriages may be provided with optically recognizable features, such as differently colored indicator signs or the like. Alternatively, the carriages may be provided with studs, pins, recesses or the like which may be mechanically sensed by a feeler or a like sensory mechanism or implement. It is also contemplated that electronic or magnetic markings may be provided on the carriages. For example, the carriages or the cans carried thereon may be provided with magnets exhibiting different magnetic strengths or attached at different positions to the carriages or the cans for sensory identification in order to distinguish between different carriages and different cans. Thus, a magnetic strip may be applied at a certain height on full sliver cans and at a differing height or other position on empty sliver cans. In any embodiment, when an empty sliver can is refilled with sliver, the indicator means is appropriately changed, which may be accomplished automatically.

According to another feature of the present invention, certain can supporting locations on the transporting arrangement may be designated for use only for supporting full sliver cans with the remaining locations on the transporting arrangement designated only for supporting empty sliver cans. Before initiating each can replacement operation, the sensing arrangement determines whether an empty can location is occupied. By way of example, alternating can supporting locations on the transporting arrangement may be designated for supporting empty sliver cans with the intervening locations designated for supporting full sliver cans. In such case, the sensing arrangement must determine for each alternate location whether the location is occupied.

The can replacement arrangement is preferably guided at each opposite side of the transporting arrangement for traveling movement along the spinning machine and includes a gantry portion which extends over the transporting arrangement and the sliver cans supported thereon. A can manipulating arrangement is supported on the gantry portion for movement along a track or rail toward and away from the spinning positions of the spinning machine, the can manipulating arrangement including a selectively operable mechanism for grasping sliver cans on the transporting arrangement and at the spinning positions of the spinning machine for carrying out a can transferring operation therebetween. A can replacement arrangement of this type requires only a sufficiently small amount of space so that such an arrangement may be retrofitted to existing automatic spinning machines which are not equipped with an automatic can replacement apparatus.

DESCRIPTION OF THE PREFERRED EMBODIMENT

Figure 1:
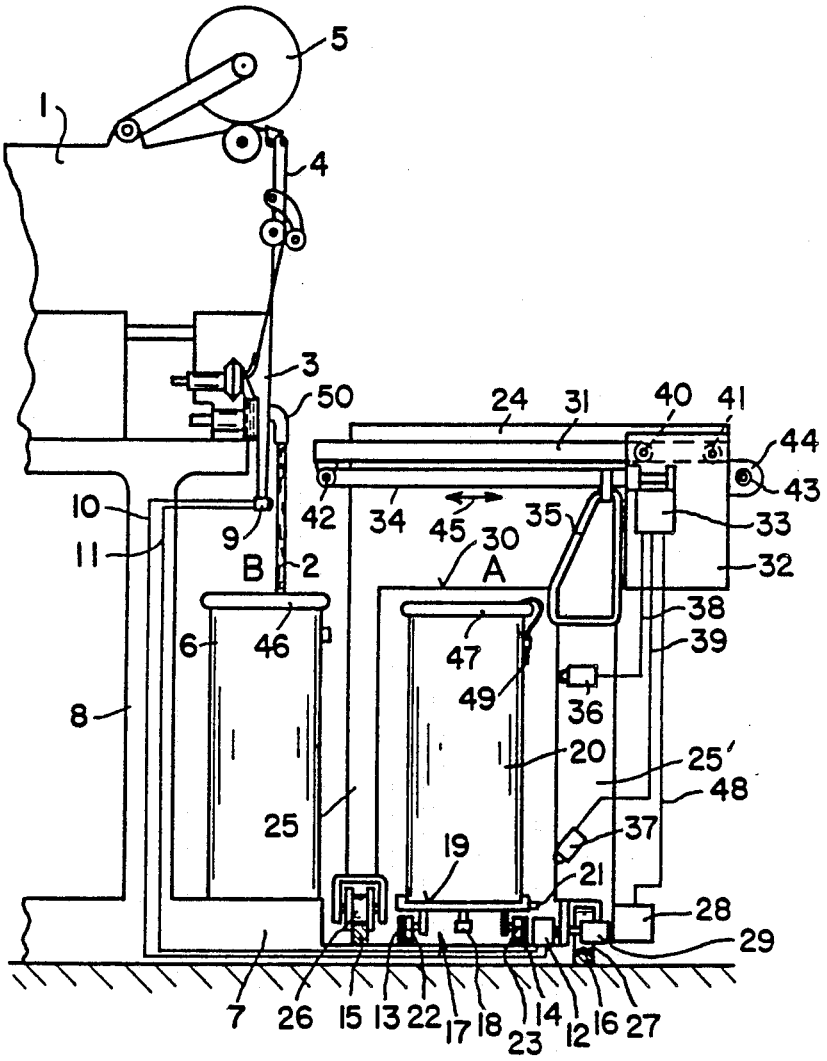
FIG. 1 is a partially schematic end elevational view of an automatic spinning machine in combination with an automatic sliver can replacing apparatus according to the preferred embodiment of the present invention.

Referring now to the accompanying drawing, one spinning position of an automatic open end spinning machine is indicated broadly at 1, it being understood that the spinning machine has a plurality of like spinning positions arranged side-by-side along the length of the machine. The spinning machine is of a conventional construction and operation and therefore need not be described and illustrated in detail herein. At each spinning position 1, a sliver 2 is delivered through a sliver guide fitting 50 into a spinning box 3 wherein the sliver is spun into a yarn 4 which is progressively withdrawn from the spinning box 3 and wound onto a cross-wound bobbin 5. The sliver 2 is supplied from a sliver storage can 6 supported on a foot portion 7 of the spinning machine frame 8 immediately below the spinning box 3. A sensor 9 is positioned to monitor the presence of the sliver 2 shortly in advance of the sliver guide fitting 50, the sensor 9 being operatively connected through electrical lines 10, 11 with a transmitter 12 to produce a can replacement signal whenever the sensor 9 recognizes the absence of the sliver 2, thereby indicating that the sliver can 6 has become empty.

A sliver can conveyor formed by a plurality of wheeled carriages 17 coupled in series to one another is guided along the forward side of the spinning machine alongside the spinning positions 1 on a pair of guide rails 13, 14 which extend in parallel spaced relation along the spinning machine. A chain 18, preferably in endless form, is connected to the carriages 17 and to a suitable drive (not shown) to apply a traction force to the carriages 17 for actuating traveling movement of the carriages 17 along the rails 13, 14. Each carriage 17 provides a single can supporting location 19 at which one sliver can 20 may be transported by the carriage 17. The rails 13, 14 extend from a can loading station located at one end of the spinning machine to a can unloading station located at the opposite end of the spinning machine. The carriages 17 are coupled to one another at substantially equidistant spacings with the can supporting location 19 of every alternate carriage 17 being designated for supporting a full can of sliver, e.g. the can 20, and the can supporting location 19' of every intermediate carriage 17' being designated for supporting an empty sliver can. (See FIG. 2) Thus, at the can loading station, a full can of sliver 20 is placed on every alternate carriage 17 while every intermediate carriage 17' therebetween is left unoccupied so as to be available for receiving emptied cans to be removed from the spinning positions of the spinning machine.

Figure 2:
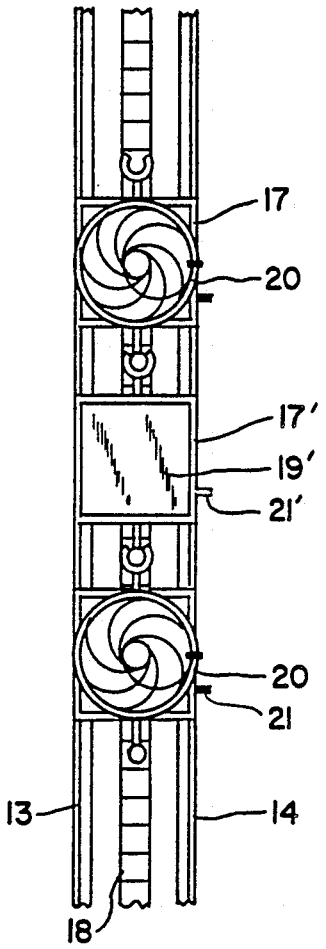
FIG. 2 is a top plan view of the sliver can transporting arrangement of the apparatus of FIG. 1.

Each carriage 17 is provided with a coded indicator 21, preferably in the form of colored pins, the carriages 17 carrying full sliver cans 20 being provided with differently colored pins, e.g. black pins 21, from the carriages 17' designated for carrying empty sliver cans, which for example are provided with white pins 21' (FIG. 2). Each carriage has a substantially flat main body of a generally square or rectangular configuration rollably supported on the guide rails 13, 14 by four rollers disposed at the corners of the carriage body, only rollers 22, 23 being shown in the drawings.

An automatic can replacement carriage assembly 24 is similarly supported for traveling movement alongside the spinning positions 1 of the spinning machine on another pair of guide rails 15, 16 extending in parallel spaced relation along the spinning machine at opposite sides of the rails 13, 14. The can replacement carriage assembly 24 includes a gantry portion 30 supported on a pair of spaced upright frame members 25, 25' to extend transversely over the guided path of travel of the carriages 17 at an elevation slightly above the cans 20 supported thereon. The frame member 25 is rollably supported on the guide rail 15 by a pair of flanged rollers 26, only one of which is shown in the drawing, and similarly the frame member 25' is rollably supported on the guide rail 16 by a pair of rollers 27, only one of which is shown in the drawing. A drive motor 28 is operatively connected to one of the rollers 27 for driving the can replacement carriage assembly 24 along the guide rails 15, 16. The drive motor 28 is operatively connected to a signal receiver 29 which is adapted to receive can replacement signals generated by the transmitters 12 associated with the spinning positions 1 of the spinning machine, whereby the motor 28 is operative to drive the can replacement carriage assembly 24 to a parked position at the spinning position 1 generating a can replacement signal in order to execute a can replacement operation at the spinning position.

The can replacement carriage assembly 24 includes a can manipulating mechanism 32 supported for movement along the gantry portion 30 toward and away from the spinning machine along a horizontal guide rail 31 mounted to the gantry portion 30. The guide rail has a generally T-shaped cross-sectional configuration, the manipulating mechanism 32 having four guide rollers 40, 41, only two of which are shown in the drawing, positioned for rolling engagement with the guide rail 31 to support the manipulating mechanism 32 for movement therealong. The manipulating mechanism 32 is connected to an endless transmission chain or belt 34 which is trained about a pair of rollers 42, 43 to extend horizontally across the gantry portion 30 beneath the guide rail 31. The roller 43 is connected to a geared drive motor 44 to be driven selectively clockwise or counterclockwise for actuating reciprocal movement of the manipulating mechanism 32 back-and-forth along the guide rail 31 toward and away from the spinning machine as indicated by the directional arrow 45.

The can manipulating mechanism 32 includes a pair of grasping arms 35 pivotable toward and away from one another as well as vertically movable, the grasping arms 35 being cooperatively configured for grasping the upper beaded edge of a sliver can. A program controller 33 controls actuation of the grasping arms 35 and the motor 44 to control the operational motions of the can replacement carriage assembly 24. The controller 33 is operatively connected with a pair of sensors 36, 37 through respective control lines 38, 39. The sensor 36 is mounted on the frame member 25' of the can replacement carriage assembly 24 in a disposition for recognizing the presence and absence of sliver cans at the can support locations 19 on the carriages 17. The sensor 37 is similarly mounted on the frame member 25' in a disposition directed toward the location of coded indicators 21 at the can support locations 19 on the carriages 17 for recognizing and distinguishing the indicators 21. The controller 33 is programmed for operation in response to the sensors 36, 37.

The operation of the apparatus of the present invention may thus be understood. The drive motor 29 of the can replacement carriage assembly 24 is normally operated to drive the carriage assembly 24 back-and-forth along the guide rails 15, 16 until a sliver can in feeding operation at one of the spinning positions 1 of the spinning machine is emptied. The sensors 9 at the respective spinning positions 1 of the spinning machine continuously monitor the presence of the slivers 2 supplied to the respective spinning boxes 3 from the sliver cans 6 thereat. As soon as the sliver 2 at any given spinning position 1 is emptied from the supply can 6, the terminal end of the sliver 2 passes the sensor 9 at the spinning position whereupon the sensor 9 immediately recognizes the absence of the sliver 2 and instantaneously delivers a signal through the operating lines 10, 11 to the respective transmitter 12 associated with the particular spinning station 1. The transmitter 12, in turn, emits a can replacement signal to be received by the receiver 29 on the can replacement carriage assembly 24. For example, the transmitter 12 may be adapted to emit a light beam in a horizontal direction so as to be intercepted by the receiver 29 when the can replacement carriage assembly 24 passes adjacent the transmitter 12 during the normal traveling movement of the can replacement carriage assembly 24. The receiver 29 then operatively controls the drive motor 28 of the can replacement carriage assembly 24 to position it in a stationary parked disposition at the associated spinning position 1 wherein the receiver 29 continuously receives the light beam emitted by the transmitter 12.

The traction chain 18 associated with the can supporting carriages 17 is driven intermittently by its associated drive to travel in a forward direction, i.e. from the can loading to the can unloading stations at the opposite ends of the spinning machine, by a distance equivalent to the spacing between successive can supporting locations on the carriages 17 and to remain at a standstill for a predetermined period of time between the intermittent actuations of the chain 18.

Once the can replacement carriage assembly 24 is parked at a spinning position 1 requiring replacement of an empty can 6 with a full can 20, the controller 33 actuates the manipulating mechanism 32 to advance toward the spinning position 1 at a point in time at which the sensor 37 detects the presence of a coded indicator 21 designating the can supporting location 19 of the carriage 17 then immediately adjacent the can replacement carriage assembly 24 to be an empty can location and simultaneously the sensor 36 detects the absence of any can supported by such carriage 17. At such point in time, the chain 18 will have just moved the carriages 17 forwardly by one can supporting location to locate an empty can location immediately beneath the line of reciprocal movement by the grasping arms 35. Once the grasping arms 35 are fully advanced to the spinning position 1 into disposition immediately above the empty can 6, the controller 33 actuates the grasping arms 35 to pivot toward one another to engage the empty can 6 beneath its beaded upper edge 46 and to raise the can slightly from the supporting foot portion 7 of the spinning machine frame 8.

The controller 33 maintains the manipulating device 32 in such disposition until the advancing chain 18 associated with the carriages 17 completes two more incremental carriage advancing cycles. Specifically, as aforementioned, alternate can supporting locations 19 on the carriages 17 are initially supplied with full cans of sliver 20 at the can loading station. Accordingly, when the chain 18 is actuated to advance the carriages 17 by another can supporting location 19, a full can 20 is positioned immediately adjacent the can replacement carriage assembly 24, whereupon the sensor 36 detects the presence of the full can 20 and the sensor 37 simultaneously detects a coded indicator 21 designating a full can of sliver. Upon the next succeeding advancement of the carriages 17 by the chain 18, another empty can supporting location 19 is brought into position immediately adjacent the can replacement carriage assembly 24 and, once again, the sensor 36 will detect the absence of a can while the sensor 37 detects the presence of a coded indicator 21 designating an empty can replacement location 19. Immediately thereupon, the controller 33 actuates return movement of the manipulating mechanism 32 away from the spinning station 1, the empty can 6 being carried by the gripping arms 35. Once the gripping arms 35 are disposed above the empty can supporting location 19, the controller 33 actuates the gripping arms to move away from one another releasing the empty can downwardly onto the empty can supporting location. Thereafter, the manipulating mechanism 32 moves further away from the spinning position 1 into a resting disposition, as shown in the drawing, to await the next advancing cycle of the carriages 17.

Once the chain 18 advances the carriages 17 by another can supporting location 19, it will be understood that another full sliver can, e.g. the can 20, is brought into position immediately adjacent the can replacement carriage assembly 24. As soon as the sensor 36 recognizes the presence of the sliver can 20 and the sensor 37 simultaneously recognizes the presence of a coded indicator 21 designating that the can is a full sliver can, the controller 33 again actuates the manipulating mechanism 32 to travel toward the spinning position 1 until the gripping arms 35 are positioned immediately above the full sliver can 20, as indicated at position A in the drawing, whereupon the gripping arms 35 are moved toward one another to engage the upper beaded edge 47 of the full sliver can 20 and the gripping arms 35 are then raised slightly to lift the can 20 from the supporting carriage 17. Immediately thereafter, the controller 33 advances the manipulating mechanism 32 further toward the spinning position 1 until the gripping arms 35 are located immediately above the foot portion 7 of the spinning machine frame 8, as indicated at the position B in the drawing. The gripping arms 35 are then lowered slightly and moved away from one another to release the full can of sliver 20 onto the foot portion 7 of the spinning machine frame 8.

In the interim, the next advancing cycle of the drive chain 8 for the carriages 17 is carried out, bringing the next succeeding empty can supporting location 19 into adjacent disposition to the can replacement carriage assembly 24. Once this incremental advancement of the carriages 17 is completed and the carriages 17 are at a standstill, which is determined by the sensor 37, the controller 33 again actuates movement of the manipulating mechanism 32 to return it to its initial resting position shown in the drawings. Thereupon, the controller 33 reactuates the drive motor 28 via the operating line 48 to cause the can replacement carriage assembly 24 to resume its traveling movement along the spinning machine or, as applicable, to direct the carriage assembly 24 to another spinning position 1 whose sliver supply can 6 has emptied in the meantime and therefore requires can replacement. At the spinning position 1 whereat a can replacement operation was just completed, the leading end 49 of the sliver in the full can is manually introduced into the sliver guide fitting 50 of the spinning box 3 by a machine operator, after which the spinning position 1 is restarted by the operator. It is also contemplated that the introduction of the leading end of sliver 49 may be performed by an automatic mechanism.

While the can replacement carriage assembly 24 in the embodiment of the present invention herein described and illustrated is operable to actuate traveling movements of its manipulating mechanism 32 toward and away from the spinning machine during standstill phases of the intermittent advancement of the carriages 17, it is alternatively contemplated that the can gripping arms 35 may be arranged to pivot sufficiently upwardly when not grasping a sliver can so as to enable the manipulating mechanism 32 to travel back and forth across the carriages 17 and the cans supported thereon without any need to coordinate the traveling movements of the manipulating mechanism 32 with the standstill phases of the transport carriages 17.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In combination with an automatic spinning machine of the type having a plurality of spinning positions each adapted for receiving a supply of sliver delivered from a respective sliver can, apparatus for replacing empty sliver cans at the spinning positions of the spinning machine with full replacement sliver cans, said apparatus comprising means for transporting sliver cans alongside the spinning positions of the spinning machine, said transporting means having locations for supporting full sliver cans and locations for supporting empty sliver cans, can replacement means for traveling movement alongside the spinning positions of the spinning machine in association with said transporting means, said can replacement means including sensing means for recognizing and distinguishing full sliver cans and empty sliver cans on said transporting means and means associated with said sensing means for transferring empty sliver cans from the spinning positions of the spinning machine to said empty can locations of said transporting means and for transferring full sliver cans from said full can locations of said transporting means to the spinning positions of the spinning machine.

2. The combination of claim 1 and characterized further in that said transporting means comprises a conveyor arranged for traveling movement along the spinning positions of the spinning machine, said conveyor having said full and empty can locations thereon in a predetermined sequence at equal spacings along the length of the conveyor.

3. The combination of claim 1 and characterized further in that said transporting means comprises a guide track extending alongside the spinning positions of the spinning machine, a plurality of can supporting carriages movably supported on said track for guided movement therealong, said carriages being coupled to one another, and traction means coupled to at least one said carriage for advancing said carriages along said track.

4. The combination of claim 1 and characterized further in that each said full can location of said transporting means comprises a detectable indicator to reflect that said location is a full can location and each said empty can location of said transporting means comprises a detectable indicator to reflect that said location is an empty can location.

5. The combination of claim 4 and characterized further in that said sensing means is arranged for determining whether an empty can location is occupied.

6. The combination of claim 1 and characterized further in that said can replacement means comprises a gantry portion extending over said transporting means and the sliver cans supported thereon and can manipulating means supported on said gantry portion for movement toward and away from the spinning positions of the spinning machine, said can manipulating means having selectively operable means for grasping sliver cans on said transporting means and at the spinning positions of the spinning machine.

* * * * *